US008561215B2

(12) United States Patent
Escudero Muñoz

(10) Patent No.: US 8,561,215 B2
(45) Date of Patent: Oct. 22, 2013

(54) CLOTHES TIGHTENING DEVICE

(76) Inventor: Juan Antonio Escudero Muñoz, Madrid (ES)

( * ) Notice: Subject to any disclaimer, the term of this patent is extended or adjusted under 35 U.S.C. 154(b) by 454 days.

(21) Appl. No.: 12/524,895

(22) PCT Filed: Jan. 25, 2008

(86) PCT No.: PCT/ES2008/000039

§ 371 (c)(1),
(2), (4) Date: Jan. 5, 2010

(87) PCT Pub. No.: WO2008/092975

PCT Pub. Date: Aug. 7, 2008

(65) Prior Publication Data

US 2010/0107311 A1 May 6, 2010

(30) Foreign Application Priority Data

Jan. 29, 2007 (ES) ..... 200700226

(51) Int. Cl.
*A41F 15/00* (2006.01)

(52) U.S. Cl.
USPC ..... 2/338

(58) Field of Classification Search
USPC ..... 2/218–221, 237, 338
See application file for complete search history.

(56) References Cited

U.S. PATENT DOCUMENTS

| | | | | |
|---|---|---|---|---|
| 1,017,544 | A | 2/1912 | Hoffman | |
| 1,384,440 | A * | 7/1921 | Faust | 2/321 |
| 2,474,629 | A * | 6/1949 | Isaacs | 2/237 |
| 2,562,386 | A | 7/1951 | McCormick | |
| 2,911,653 | A | 11/1959 | O'Donnell | |
| 4,800,594 | A | 1/1989 | Young | |
| 5,566,397 | A | 10/1996 | Scott | |
| 5,642,739 | A | 7/1997 | Fareed | |
| 5,806,087 | A | 9/1998 | Grotefend | |
| 5,970,526 | A | 10/1999 | Weathers | |
| 6,367,086 | B1 * | 4/2002 | Woodard | 2/237 |
| 7,757,308 | B2 * | 7/2010 | Oomae | 2/237 |
| 2002/0148461 | A1 | 10/2002 | Heinz et al. | |
| 2004/0107480 | A1 * | 6/2004 | Ellis | 2/237 |
| 2009/0007316 | A1 | 1/2009 | Escudero Munoz | |

FOREIGN PATENT DOCUMENTS

| | | |
|---|---|---|
| JP | 2002-266139 | 9/2002 |
| WO | WO 2007/028841 A1 | 3/2007 |

OTHER PUBLICATIONS

International Search Report for PCT International Application No. PCT/ES2008/000039 mailed Jun. 25, 2008.

* cited by examiner

*Primary Examiner* — Katherine Moran
(74) *Attorney, Agent, or Firm* — RatnerPrestia

(57) ABSTRACT

The girdle comprises two parts or halves (1-2), connected to each other by means of elastic elements (3) covered by adornments in the form of shells (6) coaxially interconnected, or any other type of unitary or fragmented adornment, wherein the plastic elements (3) are fastened to the parts (1) and (2) by means of pivots (7) selectively usable in order to vary the effective length of the girdle, length which also varies depending on the elasticity of the elements (3). Each said part or half (1) and (2) incorporates at the free end and back face thereof hooks (5) for fastening to the clasps (4) of the garment, in such a way that said elastic elements (3) cause traction between the clasps producing the girdling of the garment. The middle area of the elastic elements (3) or more specifically of the adornments encapsulating same, is visible when the parts (1) and (2) are substantially spaced, directly affecting the appearance of the girdle and constituting a changeable element.

4 Claims, 2 Drawing Sheets

CLOTHES TIGHTENING DEVICE

This application is a U.S. National Phase Application of PCT International Application No. PCT/ES2008/000039, filed Jan. 25, 2008.

PURPOSE OF THE INVENTION

This invention refers to a tightening device the aim of which is to fix a garment, such as trousers, to its user's waist, so as to appropriately stabilize said garment with respect to the user's body. To do so, it uses the loops on the garment, the grooves made in it at waist level or other similar elements.

The purpose of the invention is to achieve a tightening device which can adapt to the different distances between the loops or similar to be used, by way of elements that can be replaced and which can be varied both in their operative length or, most specifically, in terms of the range of said length due to the elastic nature of its parts as well as their appearance.

It is also object of the invention that both the loops used for assembling the tightening device, as well as the way in which said device is attached to the loops, are hidden, likewise with the same purpose of achieving an optimum appearance.

The invention is therefore an accessory for garments.

BACKGROUND OF THE INVENTION

Tightening devices for garments, particularly trousers, have been well known for many years, and in this sense mention should be made of the U.S. Pat. No. 1,017,544, dated 13 Feb. 1912, in which the tightening device has a buckle, similar to that of a conventional belt, but which does not close over itself as in the case of belts but which, rather, is formed by two separate parts which, together, affect only around half of the waist band of the trousers and are attached to the latter by buttons and button holes.

The appearance and the features of this tightening device provide the user with more or less the same performance as that of a conventional belt.

A more developed tightening device appears in the U.S. Pat. No. 4,800,594, dating back to 1987, in which the device uses a couple of loops on the trousers and materializes in a simple strip which, at each end, has "Velcro®" type adhesive elements which can be fixed to the respective loops by folding the strip back on itself. This solution is uncomfortable to use and is designed more as an aesthetic device than as a tightener, being used normally in pairs on both sides of the waist and comprising, in essence, an aesthetic element which improves the appearance of the garment at the waist but which does not participate in tightening the garment to stabilize it on the user's body.

A more recent solution is that shown in the U.S. Pat. No. 5,566,397, which is a genuine tightener, which uses a couple of loops on the garment but where, in this case, the tightener materializes in two parts in the form of rings which are fixed to said loops. Attached immovably to one of these rings is a kind of belt which passes through the corresponding part to the other loop, doubling up on itself and becoming stabilized with the collaboration of a kind of central buckle. In this case, too, the result is a tightener with the appearance of a classic belt, particularly when the user's trousers are hidden on the side by the corresponding or complementary jacket. Moreover, due to the system of fastening to the loops, it means that these are on the whole visible and undergo noticeable deformation, due to the pulling effect of the tightener, which has very negative repercussions on the appearance of the whole.

The applicant is the title holder of the invention patent P 200502173, in which he describes a tightener for garments formed by a central element which represents the support for the decorative development of the tightener, a central element of any appropriate length extended at each end with its respective tying or hooking elements which can easily be passed through the respective loops, being attached to the latter of doubling up on themselves, once again reaching the central element to be tied or fixed behind it, all of that with the necessary tension to achieve the sought-after tightening effect.

With this solution, substantial improvement is achieved both in the appearance and handling of the tightener, even though there is still a series of problems such as the visibility of the loops used and the means of fastening the device to them, the impossibility of adjusting the tightener in terms of length, the difficulty in adapting it to the waist profile, particularly when the loops are far apart, as well as other problems which will become evident during the following description.

DESCRIPTION OF THE INVENTION

The tightener proposed in this invention represents a new technical development thanks to which the elasticity of the tightener is moved to the central element itself which, in addition, can be adjusted so that it is possible to maintain any degree of tightening irrespective of the varying distances between loops that may exist on different garments worn by the same user.

To do so, and in a more specific way, the aforementioned central element is divided into two halves linked to one another by way of elastic parts which are fixed immovably to each of said halves.

A further feature of the invention is that said elastic elements can be fastened to the two halves of the central element at different points along the length, so that the effective length of the tightener may be varied substantially, providing each half with a considerable length.

A further feature of the invention is that the elastic elements will be visible, often participating in the aesthetic appearance of the central part. For that reason, it has been envisaged that these can be replaced by others, not only to vary the effective length of the tightener but also to change its appearance at will.

Yet another of the feature of the invention is that it is envisaged that the elastic part relating to the two halves of the central element, or in due course to one of the elastic parts, should incorporate a element for fastening it to the trousers or garment in question, such as a clip, so that deformation is prevented from being produced in the area of the garment between the loops to which the tightener is fastened as such deformation would have subsequent negative repercussions on the appearance of the whole. Thus it is ensured that the tightener is perfectly adapted to the waist of the garment itself.

In accordance with a preferential execution of the invention, pivotal longitudinal alignments can be established, conveniently set apart, on each one of the halves of the central element. The number of these will coincide with the elastic elements to be fastened between both halves. Each elastic element incorporates, at its end, some buttonholes or other orifices capable of receiving said pivotal elements in a stable manner. Thus, according to which of each pair of pivots is selected, an effective length for the tightener will be obtained, after which it can be lengthened elastically.

It merely remains to mention that each half of the central element, as a means for fastening it to the loop or similar element on the garment, incorporates a kind of rigid hook, preferably of a good width but, of course, not as wide as the effective length of the loops themselves. The purpose of the aforementioned dimensions of these hooks is to minimize deformation of the respective loops, affecting them nearly wholly or in their entire length. Also, said loops thus remain hidden due to the fact that the aforementioned hooks are underneath with regard to the outside edge of the respective halves of the central element.

It is also envisaged that one of these hooks should form a cross-arm clip which ensures that the tightener remains attached to the garment even when the other end becomes separated from it, thus avoiding its accidental falling down.

The elastic elements which link the two halves of the central element can be several and independent or associated with one another in their middle area, of a single-part type, with this (5) forming an aesthetic enhancer which is visible when the two halves of the central element are duly separated. It is inter-changeable with other similar ones with the object of enhancing the possibilities of the tightener from an aesthetic viewpoint.

DESCRIPTION OF THE DRAWINGS

In order to complement the description being made and in order to improve the understanding of the characteristics of the invention, in accordance with a preferential example of its practical use, this document includes, as an integral part of the description, a series of drawings which, for illustrative purposes but not limited to, are represented in the following.

PREFERENTIAL EXECUTION OF THE INVENTION

Figure 1:
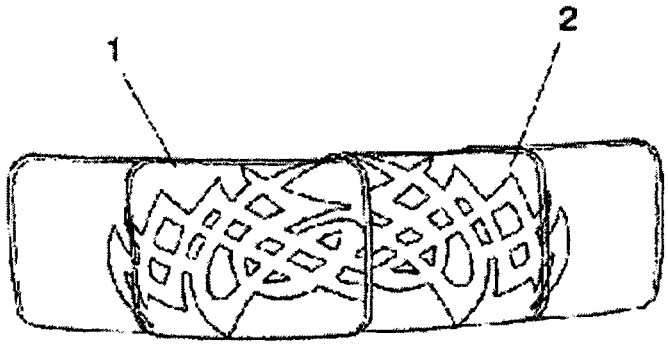
FIG. 1 shows, from a frontal perspective, the garment tightening device made in accordance with the object of this invention.
Figure 2:
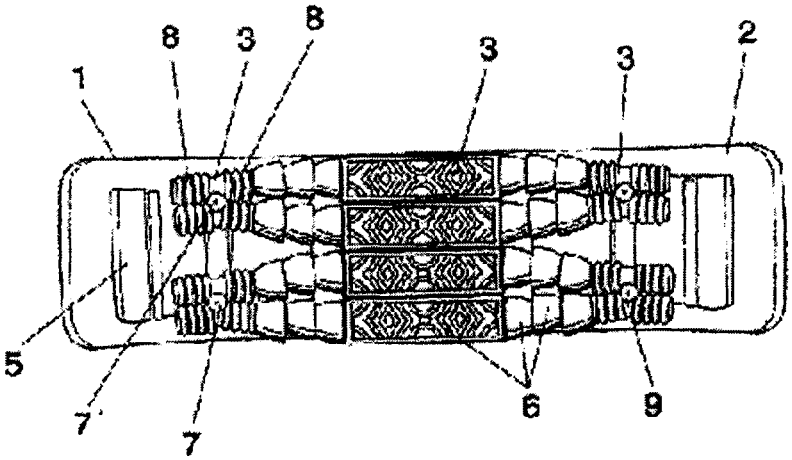
FIG. 2 shows a rear view of the whole represented in the above FIG. 1.
Figure 3:
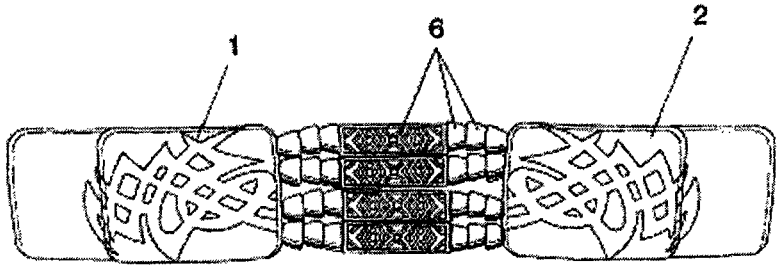
FIG. 3 shows another front view of the tightener device, similar to FIG. 1, but in a situation of maximum lengthening of said device.
Figure 4:
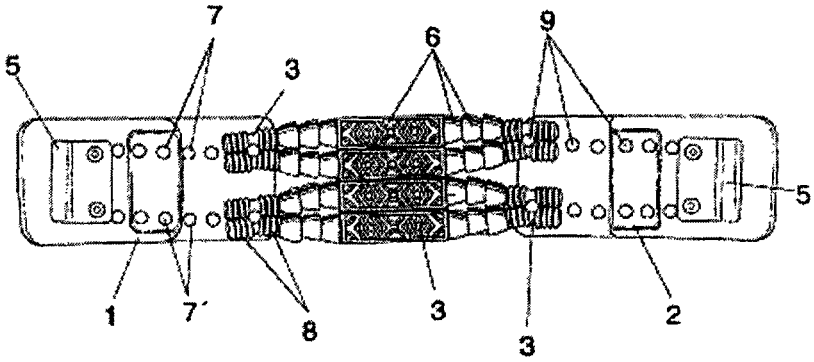
FIG. 4 shows a rear view of the whole represented in the above FIG. 3.

Upon viewing the aforementioned figures, it may be observed how the garment tightening device proposed by the invention is formed by a central element divided into two halves or parts 1 and 2 in the form of appropriately decorated flat parts, which may partially overlap—as shown in FIGS. 1 and 2—or be noticeably separate—as shown in FIGS. 3 and 4—, in either case being linked by means of elastic elements (3), such as rubber strips, which permanently tend to pull said parts together (1) and (2).

As has already been said, parts (1) and (2) are meant to be fastened to two of the loops (4) of the trousers, for which purpose on their rear side they have the appropriate attachments (5), in the form of hooks, which are meant to be attached to the loops (4), by preference of a length which is similar to but slightly less than the effective length of said loops, so as to ensure only minimum deformation thereof.

One of these attachments or hooks (5) will be equipped with a hinge mechanism and will take on the form of a closed elastic clip or any other configuration or structure that allows keeping said attachment (5) permanently fixed to the corresponding loop (4), so as to ensure that when the tightening device becomes separated from its other attachment (5) and its corresponding loop (4), the device will remain attached to the trousers or garment through the other attachment or hook (5), which can only be undone separately in a required or deliberate way by opening the corresponding clip or hinge. This prevent the tightening device from accidentally falling to the ground when, for any reason, the garment is opened at waist level.

The elastic elements (3), in other words the rubber strips, combine with several tubular elements (6), by preference made of metal, in the form of sockets which are duly decorated as they will affect decisively the appearance of the tightening device, particularly in its maximum length position as shown in FIGS. 3 and 4. Said sockets correspond to a mere example of preferential practical execution as they can be substituted by any other kind of structure capable of grouping the elastic elements (3) properly, thus benefiting the appearance of the device.

To acquire a "step-by-step" positional adjustment of the elastic elements (3) with regard to parts (1) and (2), in the example of practical execution in the figures it has been foreseen that on the rear of parts (1) and (2), which form the central element, a pair of pivotal alignments be established (7-7'), to be used selectively, whereas the elastic elements (3) are grouped in pairs, as may be observed in any of the figures from 2 to 4, with each pair of elastic elements (3), though their corresponding decorative sockets (6), being fastened at their ends by means of a pair of flat grips (8) which, appropriately distant from one another, determine, together with the elastic elements themselves (3), several orifices (9), destined to their selective attachment to any of the pivots (7).

In this way, and from the relatively short tightening device shown in FIG. 1, the device can be increased in length considerably up to the position shown in FIG. 3. From any of these two positions, it can be extended elastically by deforming or stretching its elastic elements (3), generating the appropriate tension on the user's waist by way of the loops (4) to which the two parts (1) and (2) forming the central part of the tightening device are attached.

Of course, the fastening system described for the elastic elements with regard to the parts comprising the central element is merely given as an example and said fastening, the position of which can be adjusted, can be effected in numerous different way, such as for example establishing on the rear surface of parts (1) and (2) some longitudinal 'plaques' with appropriately distributed perforations into which the hooks at the ends of the elastic elements (3) can be placed, using elastically retractile 'pins' or any other suitable means.

As may be observed from the figures, the configuration of parts (1) and (2) is such that the hooks (5) remain totally hidden and therefore totally hidden are the loops (4) to which they are attached, so that irrespective of the dimensions of said hooks (5) any noticeable deformation in the loops (4) is avoided. Even when such deformation were to occur, this would be invisible to the eye when the garment is being worn as may be seen in FIGS. 1 and 3, all of that with the subsequent repercussions on an aesthetic level.

Figure 5:
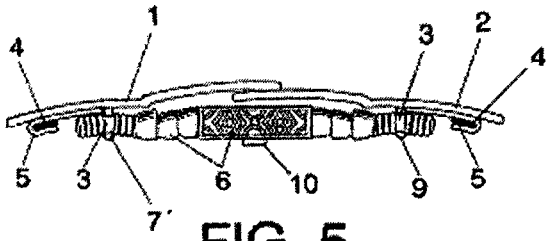
FIG. 5, finally, shows a profile or pattern detail of the tightener device in the position of the FIGS. 1 and 2.

Finally, it remains to be said, as already mentioned, that the elastic element (3) occupying the upper position or, in due course, in the upper and middle area of any other decorative element replacing the aforementioned enhancer sockets (6) covering the elastic elements, a clip (10) like that shown in FIG. 5 will be placed, with the purpose of being attached to the upper edge of the belt of the trousers or garment in question, corresponding with the front and middle point thereof, thus achieving stability for the garment-tightener, with the latter being perfectly adapted to the top edge of the garment, avoiding the garment's tendency to deform downward in the front between the two loops to which the device is attached, with the subsequent advantages on an aesthetic level, too.

The invention claimed is:

1. A tightening device for garments comprising a central element formed by a first part and a second part, each part having a rear portion, said central element provided with means for fastening said device to a respective loops of trousers wherein said first part is linked to said second part through elastic elements secured to the rear portions of said first part and said second part so that said elastic elements allows for varying the useful length of the device and, from said useful length, once again varying the length through its own elastic deformation, wherein said elastic elements can be adjusted on said first and second parts;

the means of fastening each of said first part and second part of the tightening device comprise respective tips in the form of a hook integral to the rear of said first part and second part;

said first part and said second part forming the central element have their free ends separated longitudinally with regard to the respective hooks in such a way that said hooks and the respective loops where they are attached are totally hidden in an operational situation of the tightening device, and the elastic elements remain hidden behind said first part and second part in a shortest extension of the tightening device whereas in a maximum extension of the tightening device said elastic elements are on the whole visibly located between said first part and second part forming the central element said elastic elements being covered with a series of bushings made of metal said bushings duly decorated so that they participate directly in the appearance of the device.

2. A tightening device for garments, according to claim 1, wherein each of said first part and second part forming the central element incorporates, at a rear area, one or more alignments of pivots for a selective attachment of ends of said elastic elements, said elastic elements being grouped in pairs and are fixed by flat clamps including small attachment holes to be inserted in said pivots.

3. A tightening device for garments, according to claim 1, wherein each of said first part and second part forming the central element incorporates, at a rear area, are provided with evenly distributed orifices into which the free ends of the elastic elements being attached selectively, with said free ends being configured as hooks.

4. A tightening device for garments, according to claim 1, device is provided wherein the with a rear clip which makes it possible to attach the tightening device to a top edge of the garment, so as to avoid a waist of the garment descending due to the effect produced by the tightening of the loops coming closer together.

* * * * *

UNITED STATES PATENT AND TRADEMARK OFFICE

CERTIFICATE OF CORRECTION

PATENT NO. : 8,561,215 B2
APPLICATION NO. : 12/524895
DATED : October 22, 2013
INVENTOR(S) : Juan Antonio Escudero Muñoz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 738 days.

Signed and Sealed this
Fifteenth Day of September, 2015

Michelle K. Lee

Michelle K. Lee
*Director of the United States Patent and Trademark Office*